US005735405A

United States Patent [19]

Vila

[11] Patent Number: 5,735,405

[45] Date of Patent: Apr. 7, 1998

[54] PILE UP TRAY FOR THE TRANSPORTATION OF PRODUCTS

[75] Inventor: Fatima March Vila, Barcelona, Spain

[73] Assignee: Videcart, S.A., Navarra, Spain

[21] Appl. No.: 715,752

[22] Filed: Sep. 19, 1996

Related U.S. Application Data

[60] Continuation of Ser. No. 443,474, May 18, 1995, abandoned, which is a division of Ser. No. 71,645, Jun. 3, 1993, Pat. No. 5,507,390.

[30] Foreign Application Priority Data

| | | | |
|---|---|---|---|
| Jun. 3, 1992 | [ES] | Spain | 9201137 |
| Jul. 3, 1992 | [ES] | Spain | 9202098 |
| Aug. 17, 1992 | [ES] | Spain | 9201722 |
| May 27, 1993 | [ES] | Spain | 9301161 |

[51] Int. Cl.[6] ..... B65D 21/00

[52] U.S. Cl. ..... 206/511; 206/557; 229/23 R; 229/918

[58] Field of Search ..... 229/23 R, 109, 229/918, 919, 161, 169, 172, 177, 178, 182, 182.1; 206/557, 512

[56] References Cited

U.S. PATENT DOCUMENTS

| | | | |
|---|---|---|---|
| 269,170 | 12/1882 | Bragdon | 229/23 R |
| 1,712,970 | 5/1929 | Smith | 229/182 |
| 2,965,279 | 12/1960 | Campbell | 229/178 X |
| 3,931,923 | 1/1976 | Thurston | 229/23 R |
| 3,941,305 | 3/1976 | Chipp et al. | 229/23 R X |
| 3,993,239 | 11/1976 | Exel | 229/23 R |
| 4,151,998 | 5/1979 | de la Fuente, Jr. | 206/512 |
| 4,905,834 | 3/1990 | Mur Gimeno et al. | 206/512 |
| 5,052,615 | 10/1991 | Oh et al. | 229/182 |
| 5,163,611 | 11/1992 | Singer | 229/918 X |
| 5,507,390 | 4/1996 | Vila | 206/557 |

FOREIGN PATENT DOCUMENTS

| | | | |
|---|---|---|---|
| 1023889 | 3/1953 | France | 229/23 R |

*Primary Examiner*—Bryon P. Gehman
*Attorney, Agent, or Firm*—Helfgott & Karas, P.C.

[57] ABSTRACT

The tray is form from a base piece, shaped as a small cask, forecast to be the bottom of the tray in which a rising double marginal flange is provided and to which at least an other piece is joint, piece that that is part of the side walls of the tray, walls that despite the fact could be made of two or four pieces, and even of other complementary pieces that work as the support for the vertical edges. According to another characteristic of the invention, the mentioned small cask is placed inside of the piece or pieces that form the side walls of the tray, overhanging with respect to the lower edge of the pieces that form the side walls of the tray, so that during the pile up between trays, the bottom part of each of them is assembled to the mouth piece of the immediately lower tray. It has been forecast that the side walls of the tray could be provided with folding flanges, that will fold towards the inside of the tray and be fixed by glue.

10 Claims, 15 Drawing Sheets

A-B

C-D

C-D

PILE UP TRAY FOR THE TRANSPORTATION OF PRODUCTS

This is a continuation of application Ser. No. 08/443,474, filed May 18, 1995, now abandoned which is a division of application Ser. No. 08/071,645, filed Jun. 3, 1993, now U.S. Pat. No. 5,507,390.

BACKGROUND OF THE INVENTION

The present invention relates to pile up trays or boxes, made of cardboard, intended for the transportation of different types of perishable goods, such as, for example, fruits, vegetables and other like products.

The invention also relates to a method of the manufacture of this type of trays or boxes.

When designing a tray of the type under consideration, a number of conditions that assure a good quality of boxes or trays must be taken into account such that the tray must be resistant to compression, easy to handle, must allow a good presentation of the product to be packed in it, and finally should be recyclable.

Regarding resistance no compression of the tray, the tray must be capable of holding the weight of the product without suffering any deformation of its bottom part. It must hold the stillness while the trays are piled up, it must have a high compression resisting capacity, as a function of the weight to be held, and it must be capable of withstanding vibrations and movements to which the tray is subjected. It must be capable of resisting to conditions of handling, stockage and transportation, specially to the effects of the environmental humidity, which is the case when the humidity in cold storage rooms in which the trays are placed could reach 90%.

Regarding its handling, the tray must offer the possibility of being served in an assembled state, as it is required by small users, or should be dismantable, as it is required by large users that have their own places where it is desirable to use small light machines with greater automation possible.

The tray must also offer excellent conditions for high quality printing and finally, it must avoid such elements as, for example, staples or any other non-recyclable materials.

Basic types of boxes or pile up trays of wood used as raw material or cardboard, are available on the market.

The trays made of wood, although they satisfy the resistance requirement, do not satisfy any of the other requirements previously mentioned, because they are not easy to handle, neither do they offer the possibility of a high quality printing. In addition, wooden trays are not recyclable at a lower cost.

There are many types of well known trays made of cardboard or any other similar material, which are generally formed from a plate properly shaped, with folding lines that define the bottom of the tray, from which elongated wings extend which, when forming the tray, will become the sides of the tray.

This type of trays has some problems during its manufacturing, because cumbersome operations have been needed for assembling the tray and joining the adjacent edges of its sides at the corners of the tray.

Furthermore, the trays of this type are not sufficiently resistant to compression when loaded with the goods and piled up.

This disadvantage occurred because of the difficulty in the folding required for this type of a tray. To do this operation, cardboard has been used, specifically undulating cardboard, that besides offering a low level of resistance is highly absorbent to humidity, which contributes to a quickly damage of the tray.

In many cases, to reinforce the tray, additional pieces are used, particularly placed at the corners. The faces of the tray are reinforced with two flanges bent over the faces of the tray.

This procedure is complicated and increases the cost of production of the tray and, in most cases, the tray does not gain the necessary resistance.

Another problem inherent to conventional trays formed from one piece, is that for providing the graphic printing on the trays, the entire tray must pass through the printing machine even if the printing required is very small or it must be printed in a very small zone of the tray.

SUMMARY OF THE INVENTION

It an object of the present invention to provide a stockable tray or box which would avoid the above-mentioned problems.

According to the present invention, a tray is made, instead of the common undulating cardboard used for the transportation of fruit and vegetables, of compact cardboard, and instead of being made as a one piece body, is assembled from single pieces, properly glued to each other.

According to an embodiment of the present invention, the tray includes a base piece, shaped as a small cask to be the bottom of the tray in which a rising double marginal flange is provided and to which at least another piece is connected that is part of the side walls of the tray. The walls could be made of two or four pieces, and even of other complementary pieces that act as the support for the vertical edges of the tray.

According to another embodiment of the invention, the base piece shaped as a small cask is placed inside the piece or pieces that form the side walls of the tray, overhanging the lower edge of the pieces that form the side walls of the tray, so that during the piling up of the trays, the bottom part of each of them is assembled into the mouth piece of the adjacent lower tray.

The side walls of the tray can be provided with folding flanges, that will fold towards the inside of the tray and be fixed by the glue, to provide more resistance to the tray.

The structure of the multi-piece tray allows to use pieces of different thickness, for the purpose of increasing mechanical resistance of the tray where needed.

The pieces that form the side walls of the tray can have at their lower edges, separate notches and at their upper edges rising wings complementary to each other to fit together during the piling up of the trays.

The vertical edges of the tray can be arch-shaped. The vertical edges of the tray can also have a feather-edge shape.

The bottom of the tray can be provided with internal marquetry rising to the outside, and the support plate can be glued to the rising marquetry, covering the entire bottom of the tray.

The method of manufacturing a tray of the present invention includes making an indentation in the piece designed to form the bottom part of the cask, and placing the cask over the edge of the shaping piece that is spaced from the tray, immediately joining to the cask at least one sheet-like piece shaped as a band and with one of its longitudinal edges glued to the outside surface of the flange of the cask, allowing at least one portion of the flange to be uncovered. The band totally surrounds the bottom until the edges are glued to each other so that the band is placed around the shaping piece forming the side walls of the tray. The procedure ends when the shaping piece is separated from the formed tray.

According to another preferred embodiment, beveled portions are formed which constitute a marginal flange that determines the bottom of a height considerably higher at these beveled portions, while the side walls of the tray that can be obtained from one or more pieces which also correspond to the beveled portions, fold over themselves to define, at the corners of the tray, a remarkable thickness because of the resulting three layers of the wall.

According to another embodiment, the tray made of compact cardboard as a raw material for its manufacture, is formed from a plurality of various pieces jointed by a glue. The tray may be formed of five pieces of which one forms the bottom, and the other four form the side walls, wherein the side walls set up against each other have elongations formed as folding wings from folding cross lines, which superpose and are glued to the other side of the tray, covering them totally. The other sides also have elongations formed with folding wings at their edges, from folding cross lines, which superpose and are glued to the edges of the former sides of the tray.

The larger sides of the tray are provided along the upper edge with the flanges bent and glued to the inside surface of the corresponding side. The larger sides have at their edges the folding flaps glued to the outside surface of the smaller side of the tray, covering them totally.

The upper edges of the smaller sides are provided with protruding or rising wings that are complementary in shape and position with notches provided in the lower edges of the same sides, so that the protruding wings can be inserted into the respective notches when piling up the trays, avoiding the movement of the trays when they are piled up.

The wings that appear from the edges of the smaller sides have at their upper edges rising wings that correspond to the cuts provided on the bottom of the tray, next to the flanges of the bottom. These wings and cuts fit into each other when piling up the trays, contributing to the immobilization of the pile.

Larger sides and small sides of the tray fold down to the level of the bottom of the cask, or of the tray as a whole.

In accordance with the above-described structure, the procedure for making this type of trays includes forging a piece to form the bottom of the tray, provided in correspondence with its edges with other marginal flanges that are folded according to the folding lines that limit the shape of the bottom. At the same time, the strips or pieces that form the lateral sides or walls of the tray with their corresponding edge wings, are provided with cross lines for folding. These strips or bands are glued along the flanges of the bottom. Two of the opposite faces or sides are bent from the folding lines in a raised position and, at the same time, the corresponding elongations are bent as wings according to their folding lines.

Two other sides and their corresponding wings are bent as it was described before, until the wings of each side are superposed and glued to the adjacent edges of the adjoining sides.

Finally, the bands corresponding to the faces of the tray may be precast to be slightly oversized and provided in their positions corresponding to the bevels of the corners, with a double folding line at a medium level to ensure adaptation of the elongations of the sides to the strips of the larger side walls and corresponding elongations of the same. The oversizing of the bands forces them to deform and form a section corresponding to ones that form the hollow columns precast to facilitate the dovetail joint between the trays, during the piling up of the same.

Optionally, this oversizing of the bands or strips could be considerably greater, so that by folding of the same over the portion corresponding to the hollow columns, those columns become solid. With this, a reinforcement during the piling up of the trays is gained in addition to the guiding effect that has been mentioned before.

Additionally, the bottom and the beveled portions of the tray are provided with wide notches that are complementary in size and shape with the section of the hollow columns, which have at the inside wall an upper projection, preferably of trapezoidal shape, intended to be placed in the notch of the next upper tray in the pile.

An important characteristic that is achieved with this invention is the optimization of the printing operation, because the tray is formed from different and independent pieces that could be printed on as the client will want of the tray, so that only the pieces of the tray that need to be printed on will be sent to the printing machine.

DESCRIPTION OF THE PREFERRED EMBODIMENT OF THE INVENTION

The pile up tray of an embodiment of the present invention is shown in FIGS. 1 to 14. A portion of a piece (1), made of cardboard or any other similar material, previously formed as a cask with very small depth, has a flange (2) bent all around.

Figure 9:
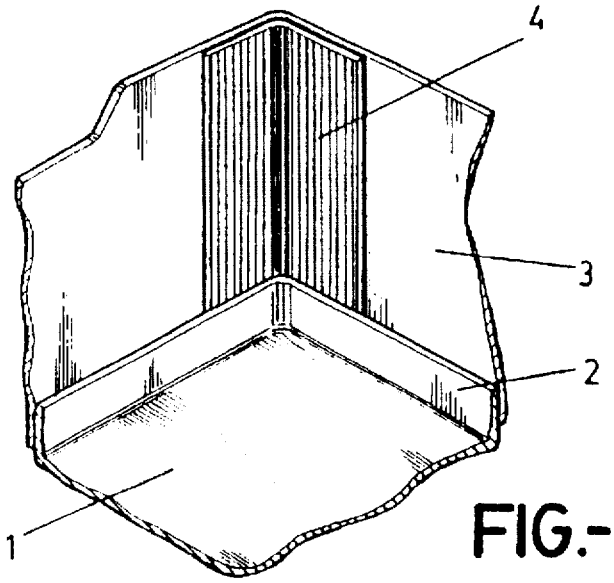
FIG. 9 is a perspective view of a detail of a corner of the tray provided with sharp edges.

Furthermore, two bands (3) were previously formed (could be only one or more than two), which were made of cardboard or any other similar material, and to which optionally, support strips (4) are glued such that, once the tray is built, they will support vertical edges of the tray (5) which could have a round (FIG. 8) or a sharp edge (FIG. 9).

The bottom (1) is assembled to an edge (6*a*) of a forming device (6), whose shape matches the shape of the cask. Next, the band or bands (3) are applied to the forming device, with the edges (3*a*) and the extremities (3*b*) previously glued to the flange (2) and the extremities (3*b*) glued to each other so the bands totally enclose the forming device (6) and form the side walls of the tray (5) (FIGS. 1 to 5).

Depending on whether the forming device (6 has round, beveled or sharp edges, the tray will have its edges of one type or another.

Figure 11:
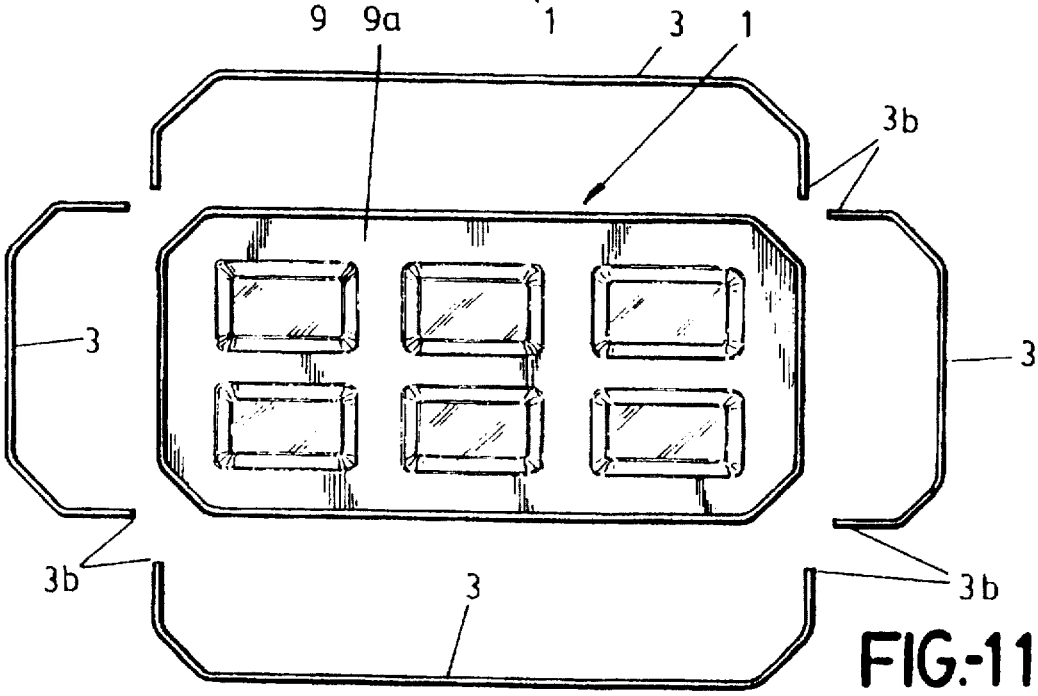
FIG. 11 is a diagrammatic view of the whole piece that will form the bottom of the tray, with bevel edges and four pieces that will form the sides of the tray.
Figure 12:
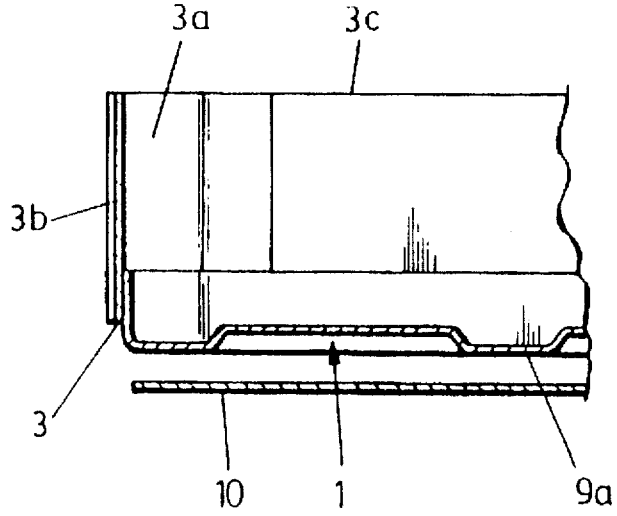
FIG. 12 is a longitudinal section of a detail of the edge of the tray formed from the components shown in FIG. 11, and having a plate to be assembled to the bottom of the tray.
Figure 13:
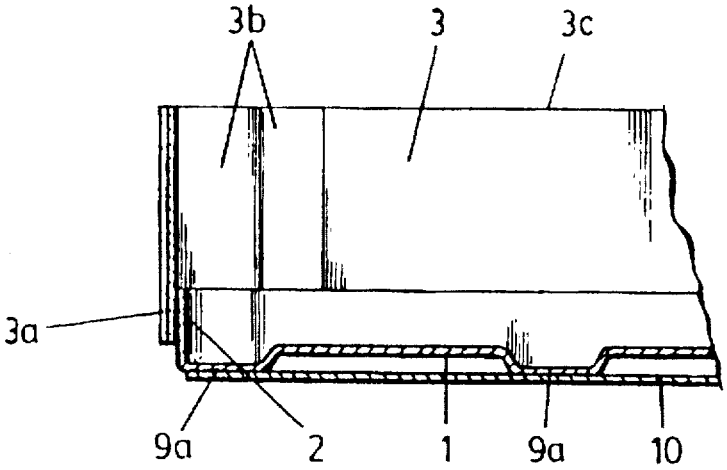
FIG. 13 is a similar view to that of FIG. 12, with the plate properly assembled to the bottom of the tray.
Figure 14:
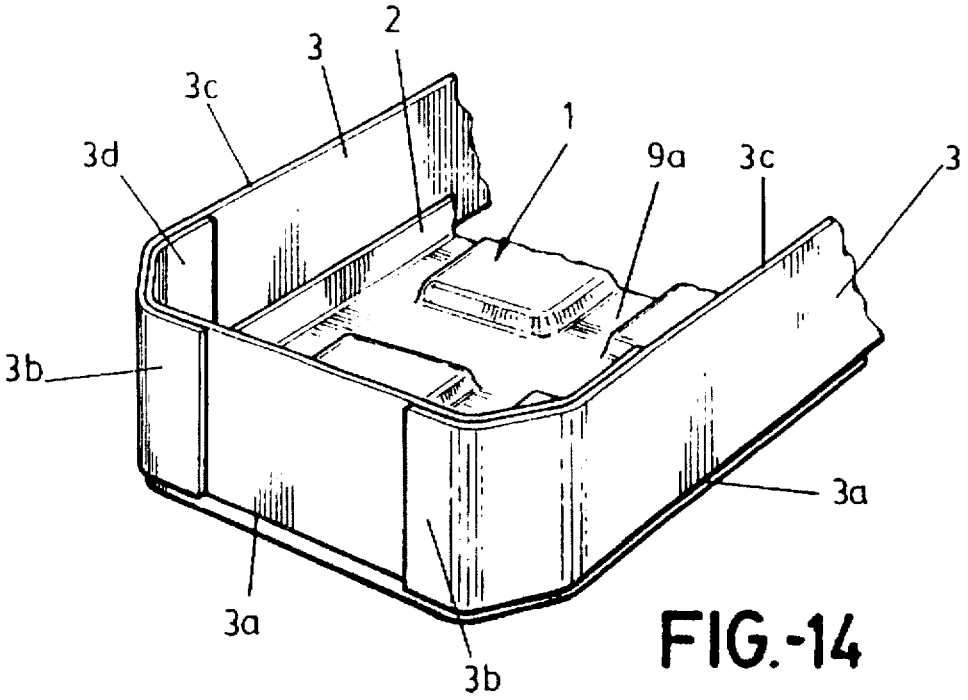
FIG. 14 is a partial perspective view of a tray with the components shown in FIGS. 11 to 13.
Figure 15:
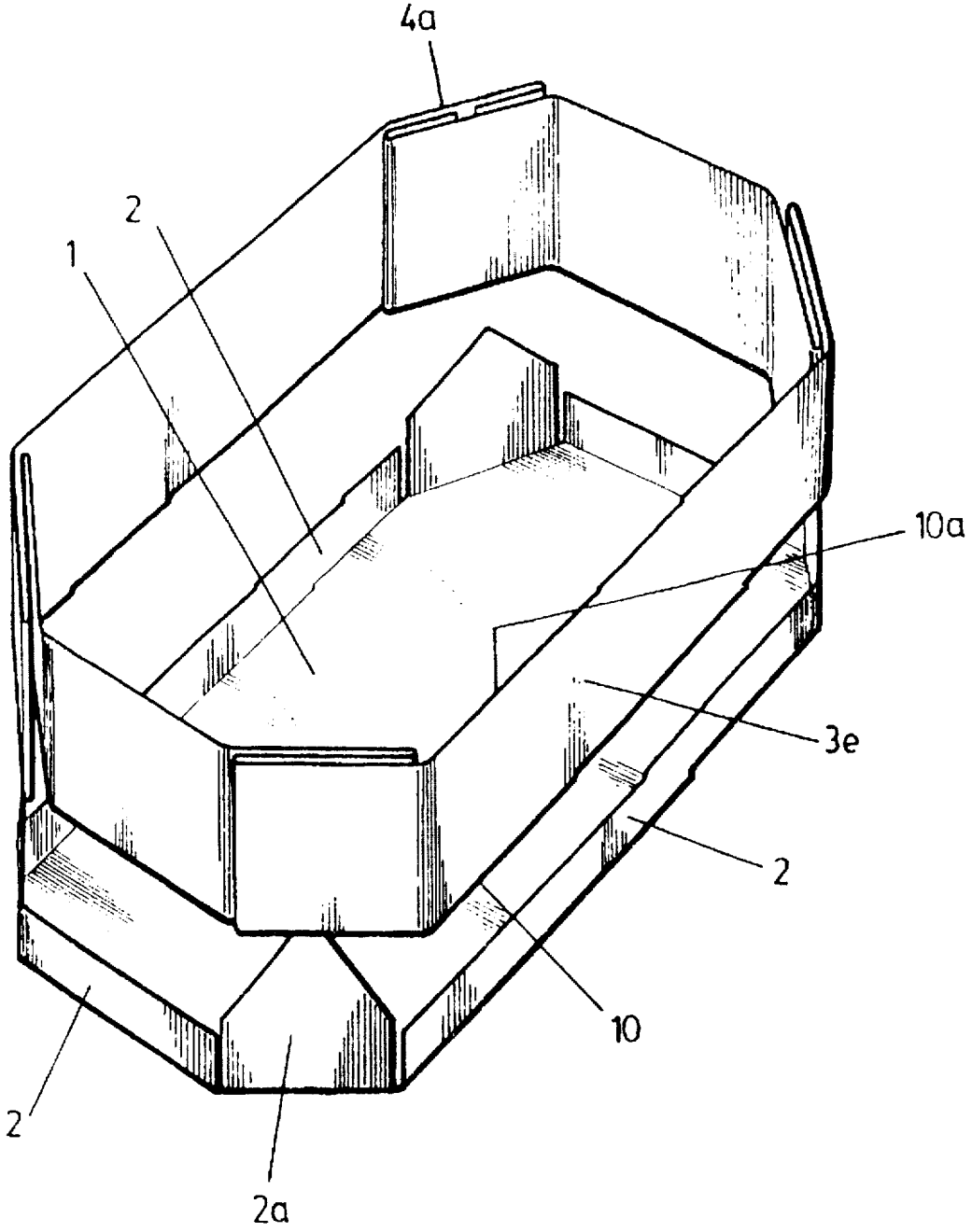
FIG. 15 is a perspective view of a tray with bevel edges, according to another embodiment in which the edges of the tray have been reinforced by a fold of the band that forms the side walls of the tray.
Figure 16:
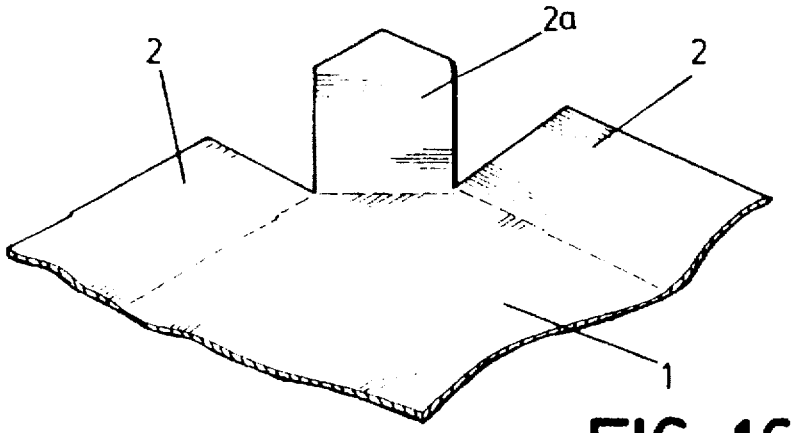
FIG. 16 is a partial view of the piece that forms the bottom of the tray, at one of its corners.
Figure 17:
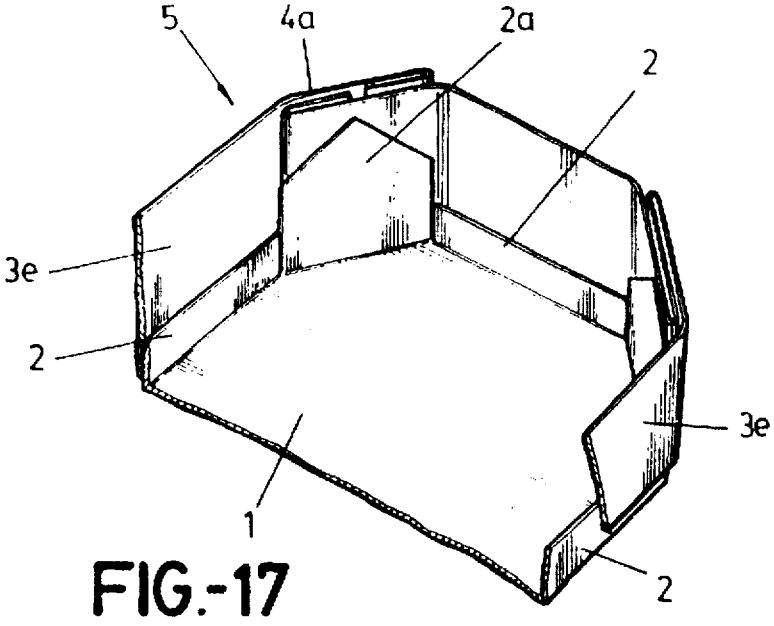
FIG. 17 is a partial perspective view of the tray of FIG. 15, after it has been totally assembled.

As seen in FIG. 11, which is a diagrammatic representation of the prior stage of the manufacturing process of a tray, the tray has a bottom (1) and four bands (3) whose extremities (3*b*) will be superposed when manufacturing the tray (FIGS. 12 to 14), to reinforce the vertical edges of the tray.

In the case where there is only one tray (3), the procedure will be almost the same, so that the single band will totally surround the forming device (6) and its extremities will be jointed together.

Once the bands (3) are glued to the flange (2) of the bottom (1), the next step is to separate the forming device (6) and to extract therefrom the tray (5) already formed.

According to this process of manufacturing, it is possible to obtain different types of trays as a function of the special characteristics of the bands (3) and of the bottom (1).

In the case where the edge of the lower extremity (3*a*) of the bands (3) is continuous (FIGS. 4, 5, 8), the bands will be placed separately from the bottom (1), that slightly overhangs with respect to the edge of the extremity (3*a*). When piling up two trays (5) (FIG. 5), the upper edge (3*c*) of the bands (3) is assembled around the overhanging portion of the flange (2) of the bottom (1) and will lie against the edge of the extremity (3*a*).

Figure 1:
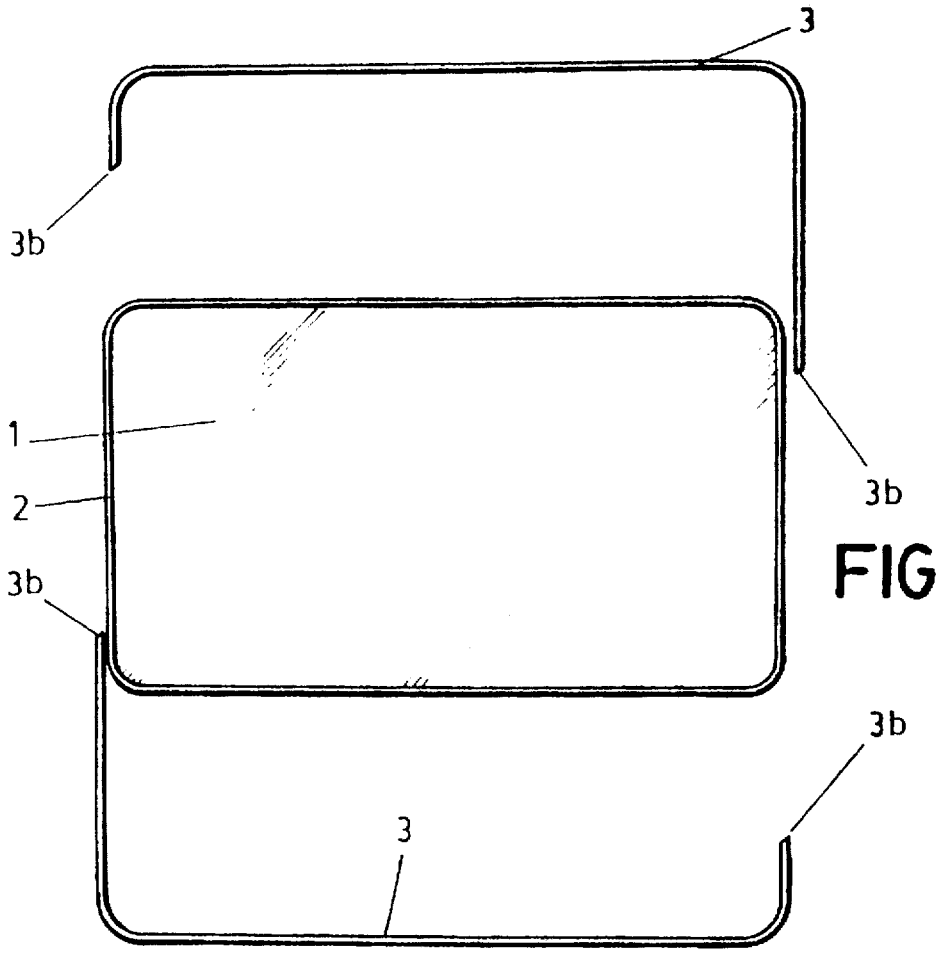
FIG. 1 is a diagrammatic side elevation section view of a piece that forms the bottom of the tray and two pieces or bands that will form the side walls of the tray, made in accordance with the manufacturing process, subject of the present invention.
Figure 2:
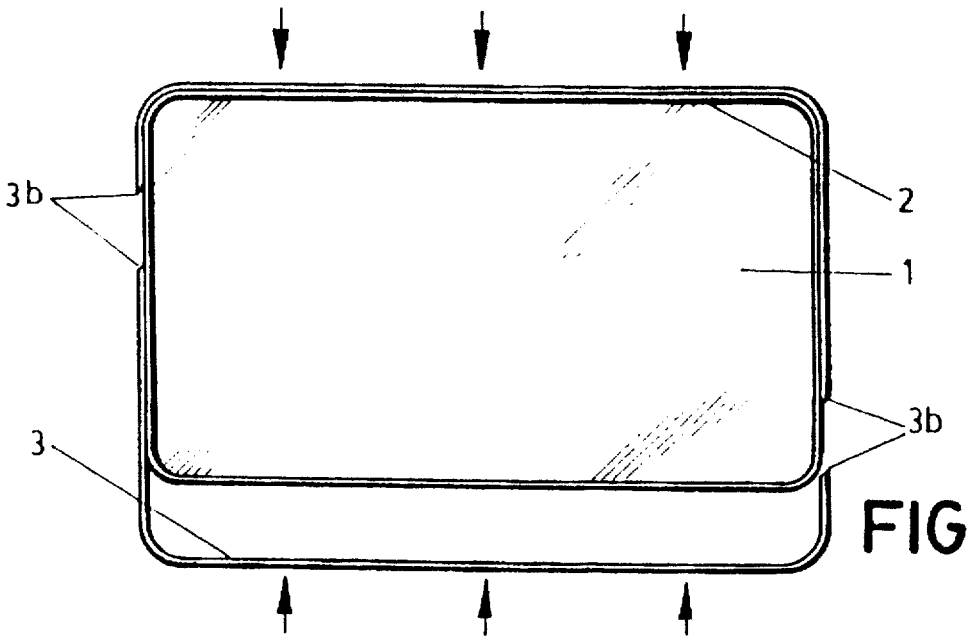
FIG. 2 is a similar diagrammatic view of FIG. 1, showing the stage of adjustment of the side strips or bands to the bottom piece.
Figure 3:
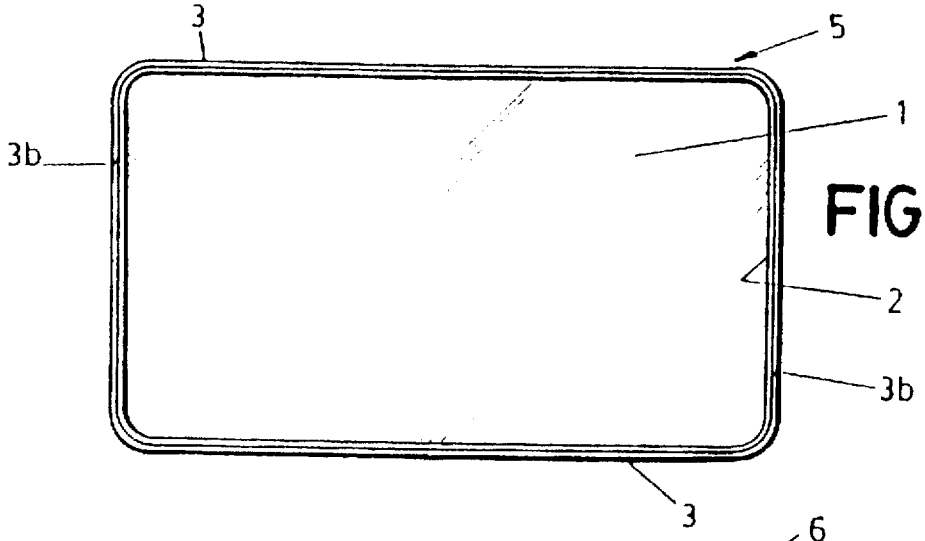
FIG. 3 shows a diagrammatic section view of the tray entirely formed.
Figure 4:
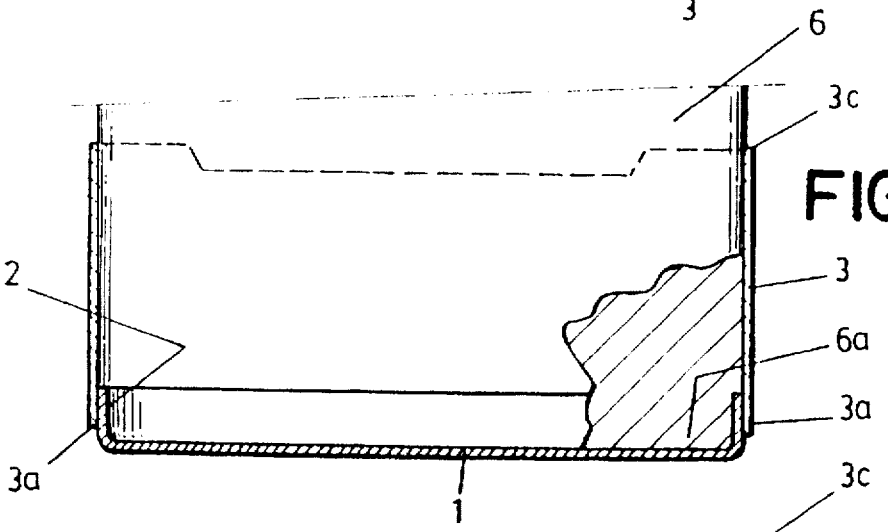
FIG. 4 is a longitudinal section view of the tray, at the end of the manufacturing process, before joining to the forming piece.
Figure 5:
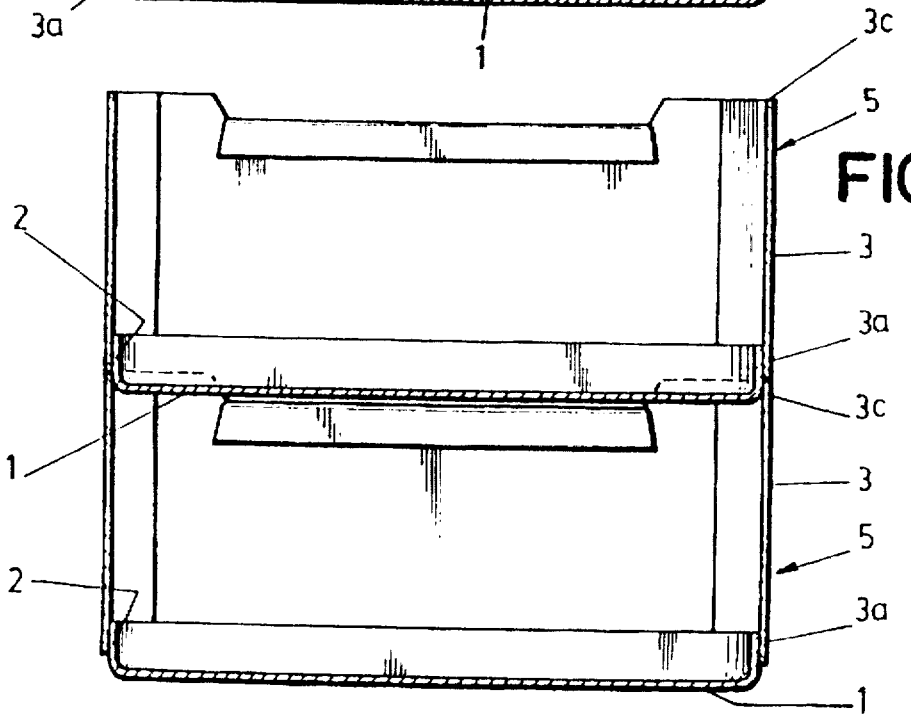
FIG. 5 is a longitudinal section of the two trays piled up.
Figure 6:
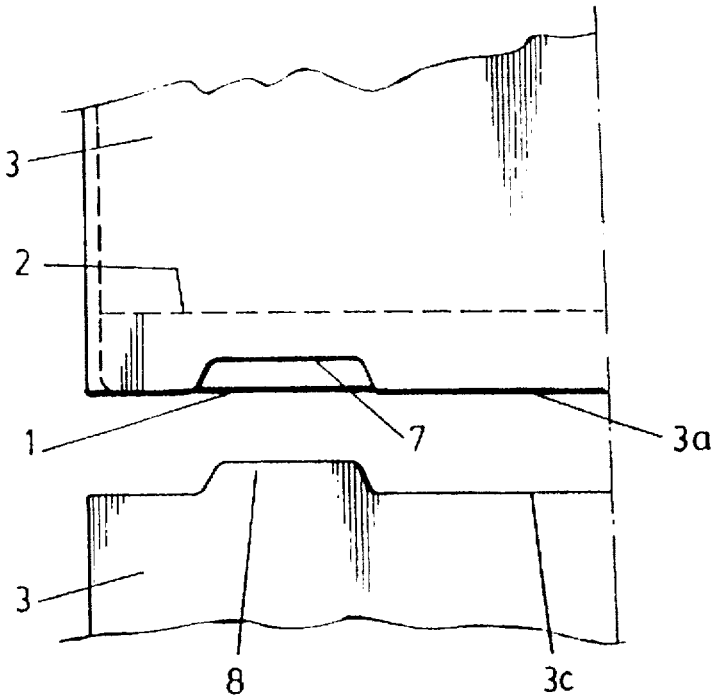
FIG. 6 shows a detail side elevation view of two trays, at the moment of being piled up, with the complementary notch and wing-shaped protrusion built on the edges of the side walls, for joining to each other.
Figure 7:
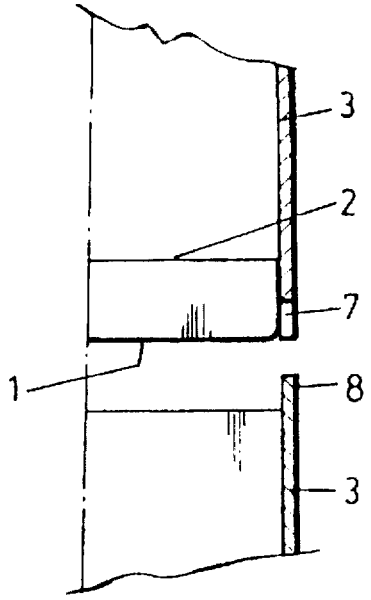
FIG. 7 shows a detail, in a section view, of components of the dovetail-shaped joining that is shown in FIG. 6.
Figure 8:
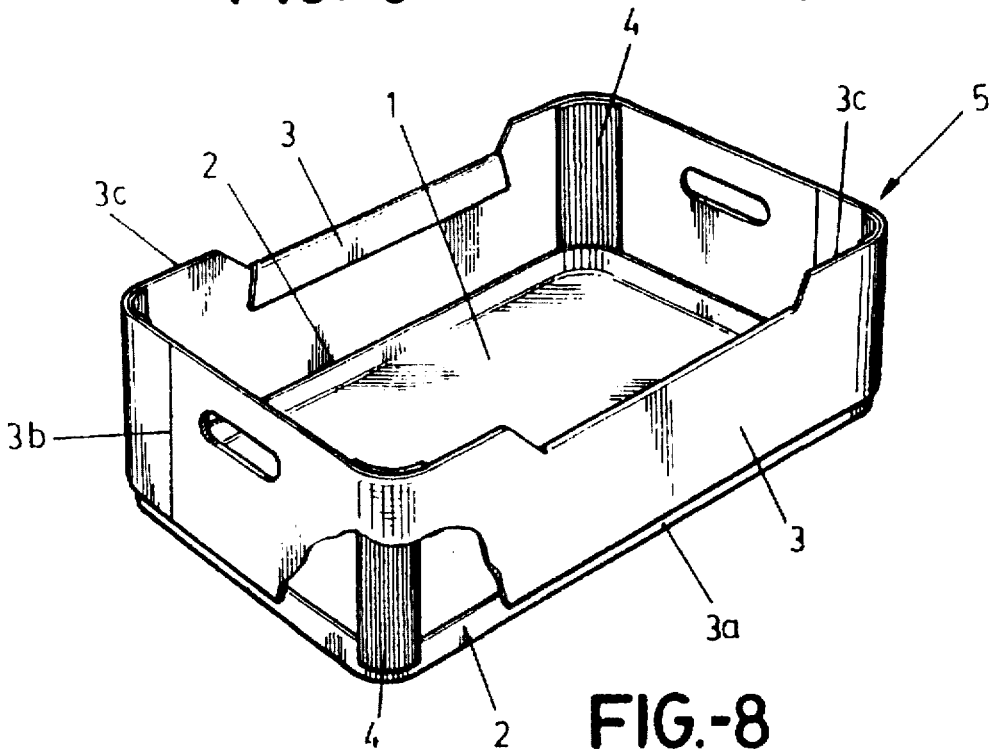
FIG. 8 is a perspective view of a tray with round edges, manufactured by the manufacturing process of the present invention.

The lower edge (3*a*) of the bands (3) has notches (7) and the upper edge (3*c*) has wings or protrusions (8) of a complementary shape to the notches (FIGS. 6 and 7). When piling up two trays (5), the wings (8) of the lower tray will be placed in the notches (7) of the upper tray.

The cask (1) was precast to have projections (9) protruding to the outside (FIG. 10), in order to provide greater resistance to the bottom part. It is possible to attach a support plate (10) to these projections.

According to an embodiment of FIGS. 15 to 18, and for obtaining a tray (5) having its vertical edges beveled similarly to the embodiment of FIGS. 11 to 14, the bottom of the box has been precast not from one piece of a cask shape, but instead from a sheet piece in which a central sector (1), corresponding to the bottom of the box, is basically rectangularly shaped.

Vertically extending wings (2) and (2*a*) are glued to the edges of the rectangular bottom, which correspond to the side walls of the cask. In this case, the wings (2*a*) correspond to the beveled edges of the corners and are substantially oversized with respect to the remaining wings (2).

Additionally, the side walls of the tray are formed by one band (3*e*) that is fixed to the wings (2) and (2*a*) by a glue and, in correspondence with the bevel shape of the corners, it has folds (4*a*) that define a triple wall of these bevel areas of the vertical edges of the box, with the consequent and remarkable development that gives the tray stiffness and resistance to compression, specifically when piling the trays up.

Figure 18:
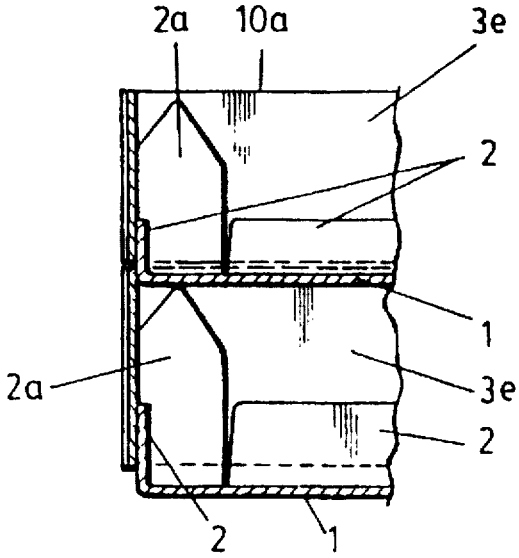
FIG. 18 is a partial longitudinal section of two trays piled up.
Figure 19:
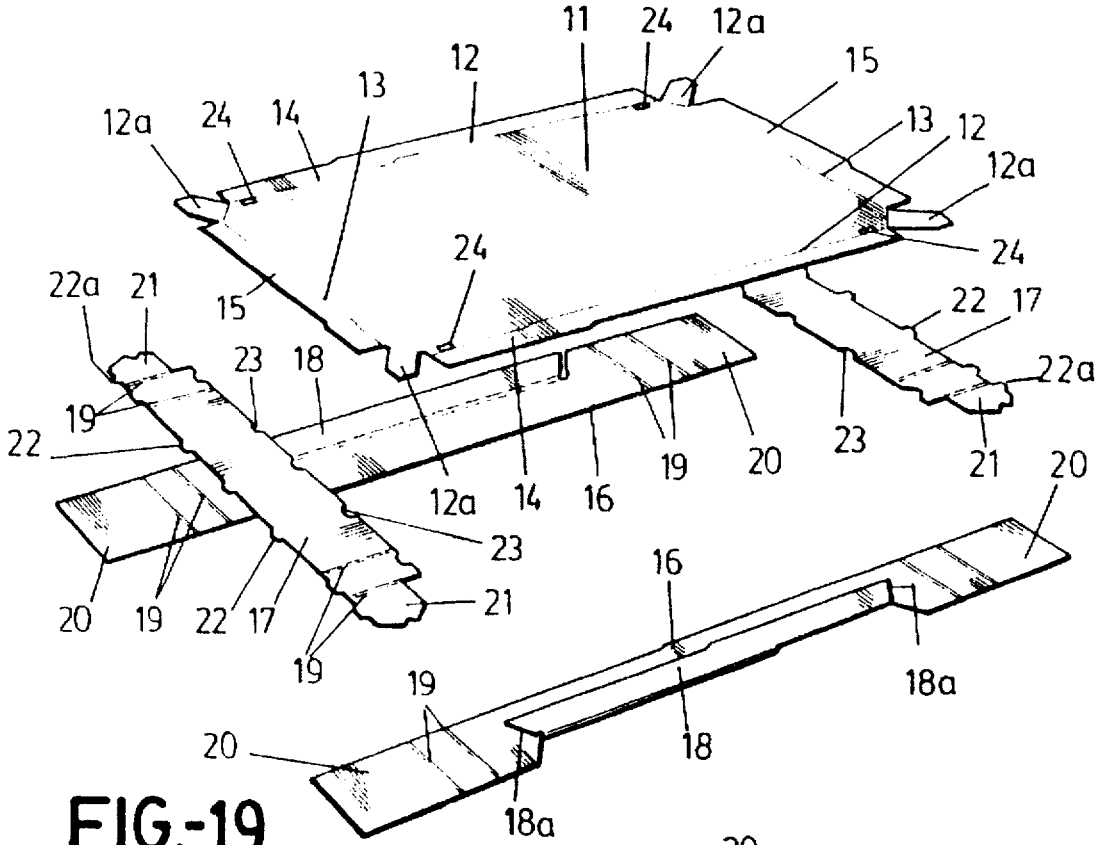
FIG. 19 is an exploded perspective view of the basic components from which the tray is obtained.

The piling up of the trays is carried out by assembling the protruding part of the bottom of one tray with respect to the side wall (3*e*) of the same tray, in the interior of the tray immediately below, as is seen specifically in FIG. 18, so that the lower marginal edge (10) of the side wall (3*e*) of the box will lie perfectly over the upper edge (10*a*) of the side wall (3*e*) of the box or tray which is immediately below in the pile.

According to the embodiment of FIGS. 19 to 26, the tray is obtained from a cardboard plate of a rectangular shape, with folding lines (12) and (13), parallel to each other and to the sides of the plate, that define folding flanges (14) and (15) positioned around the plate (11) that will form the bottom of the tray to be built.

At the corners of the plate (11), there are provided folding wings (12*a*).

The sides of the tray are formed from two strips (16) made of cardboard, that constitute two larger sides and two strips (17) that form two smaller sides of the tray.

The larger sides (16) have along their upper edges, longitudinal flanges (18) bent and glued over the inner surface, with extremities (18*a*) bevel shaped.

The sides (16) and (17) have transversal folding lines (19) that define the wings (20) on the sides (16) and (17). The wings (20) are larger than the wings (21), and between each pair they have the same length as the smaller sides (17).

Figure 20:
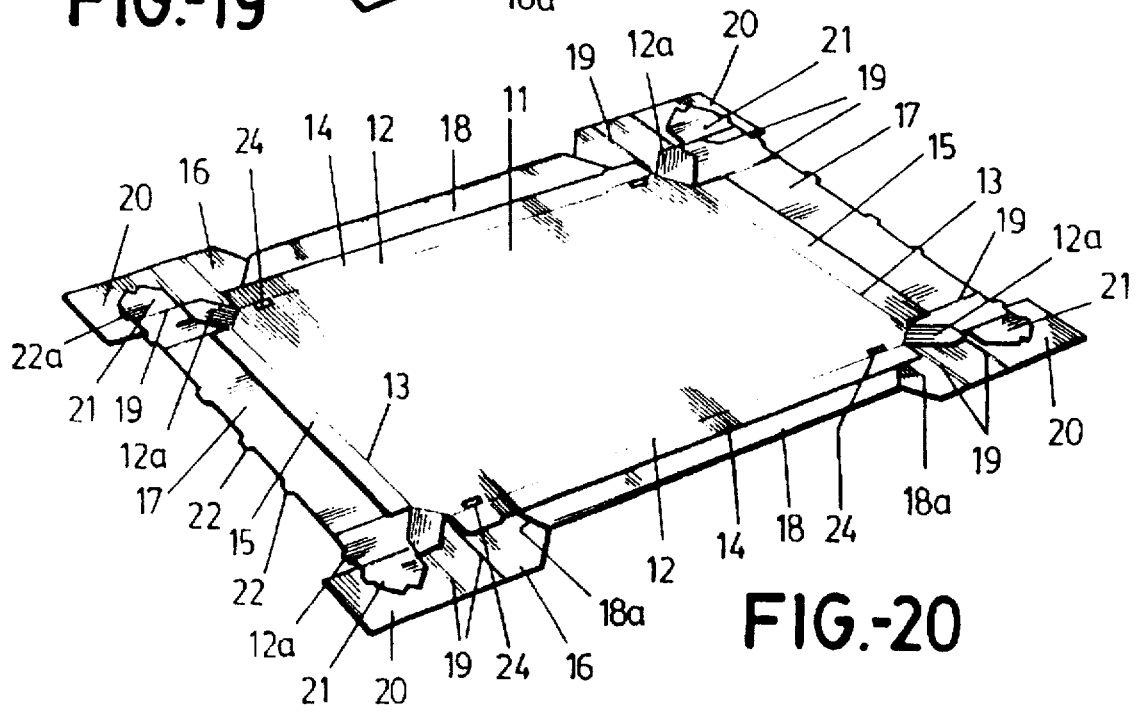
FIG. 20 is a view showing the components of FIG. 19 glued together.
Figure 21:
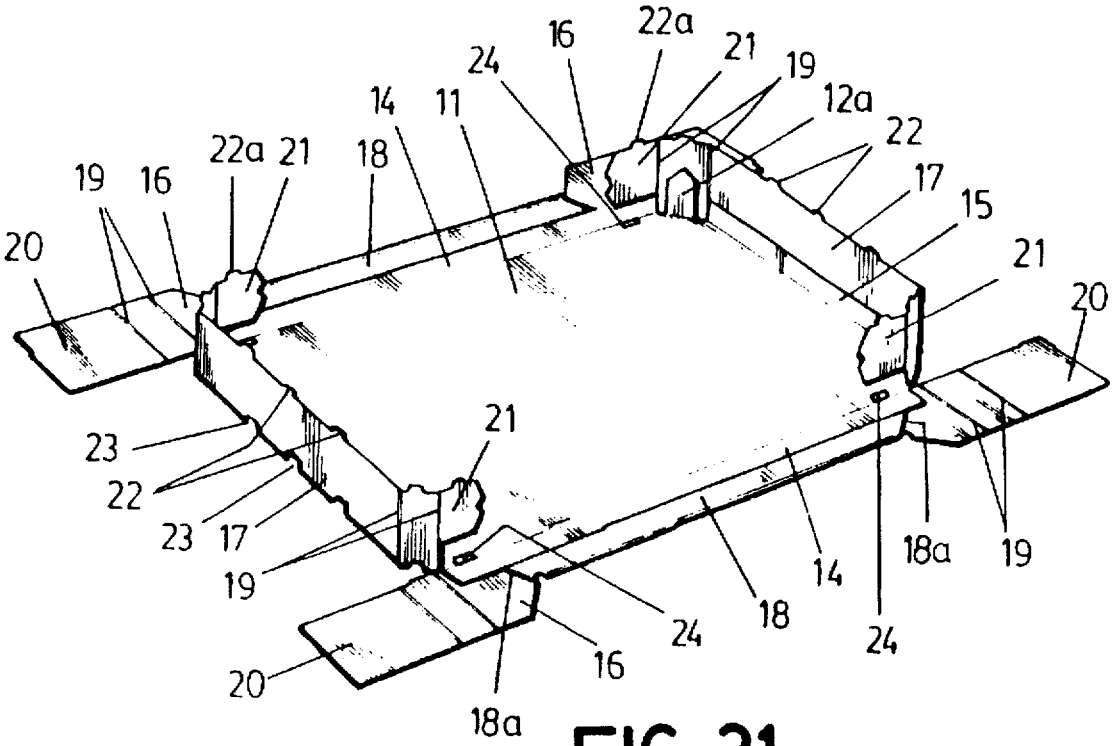
FIG. 21 is a perspective of the tray at a first glueing stage of two smaller sides of the tray shown in FIGS. 19 and 20.
Figure 22:
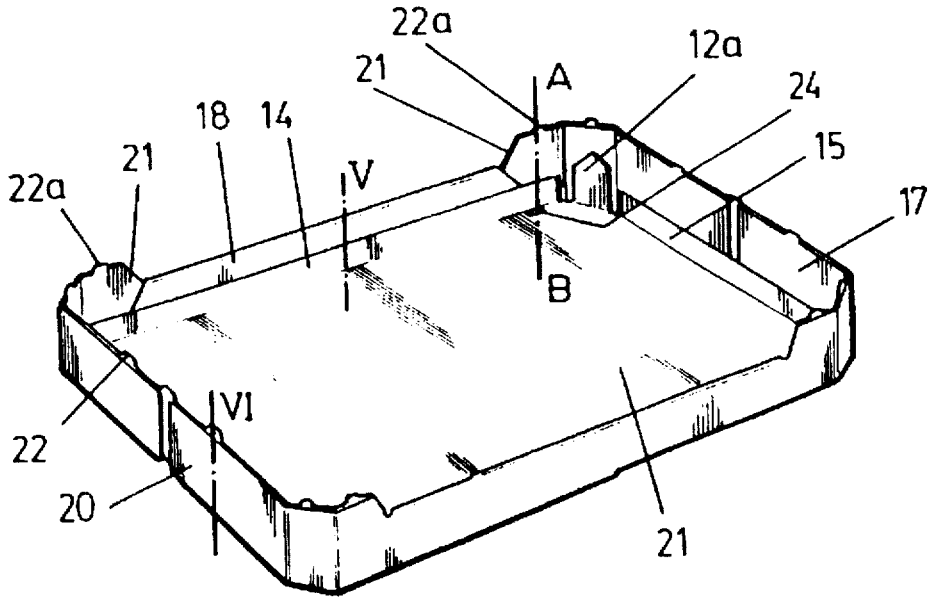
FIG. 22 is a perspective view of the tray at the final stage of the manufacturing process when the respective sides and flaps are folded and glued together.
Figure 23:
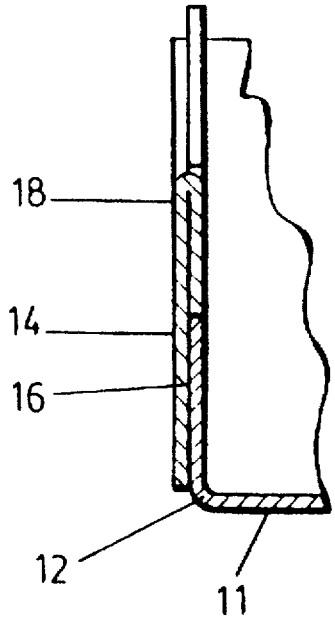
FIG. 23 is a sectional view of a detail of the tray, along plane V of FIG. 22, on a larger scale.

The manufacturing procedure consists of glueing the lower edge of the faces (16) to the flanges (14) and of the sides (17) to the flanges (15) (FIG. 20). Once this set is formed, the next step is folding the smaller sides (17) and its wings (21) (FIG. 21). Next, the larger sides (16) are folded and then the wings (20). The wings (21) are glued to the inner surface of the edge of the sides (16) and the wings (20) are glued to the outside surface of the sides (17), which are totally covered (FIG. 22).

The glueing of the wings could be done either prior to the above-described operations, by using thermoactive glue, or during the above operations.

The manufacturing process described is very simple. The process is carried cut from five pieces of cardboard, namely the plate (11), two sides (16) and two sides (17). This allows to obtain the plate (11) with a different thickness of the sides (16) and (17), to vary resistance of the tray. The process also allows the realization of printing on the sides (16) an (17) in a simpler way than that in the known trays, because it allows the introduction of single strips, which are easy to handle, instead of the entire plate, as it happens with prior art structures, that present a lot of difficulties in their handling.

The smaller sides (17) and wings (21) have at their upper edge protruding wings (22) and (22*a*), respectively. On the lower edge of the sides, there are notches (23) complementary in position and shape to the wings.

Furthermore, the bottom (11) of the cask has next to its corners openings (24) whose position corresponds to the position of the protruding wings (22*a*) of the wings (21).

Figure 24:
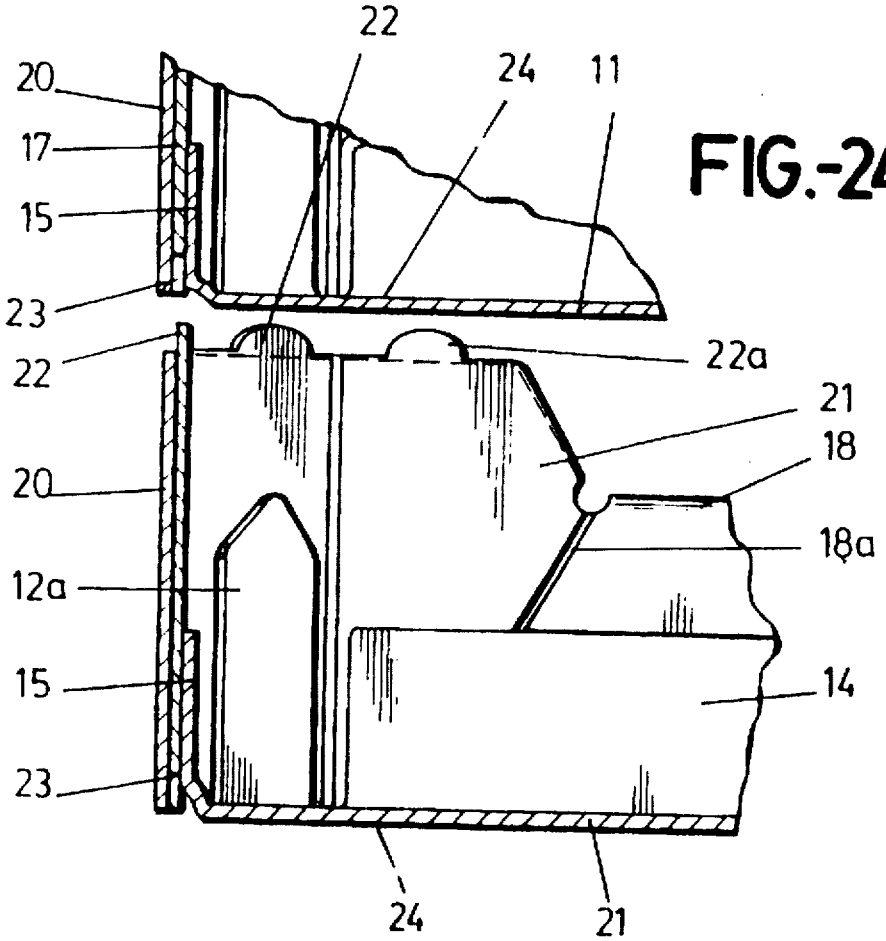
FIG. 24 is a partial sectional view of two trays, taken along plane VI of FIG. 22, just before the trays are to be piled up.
Figure 25:
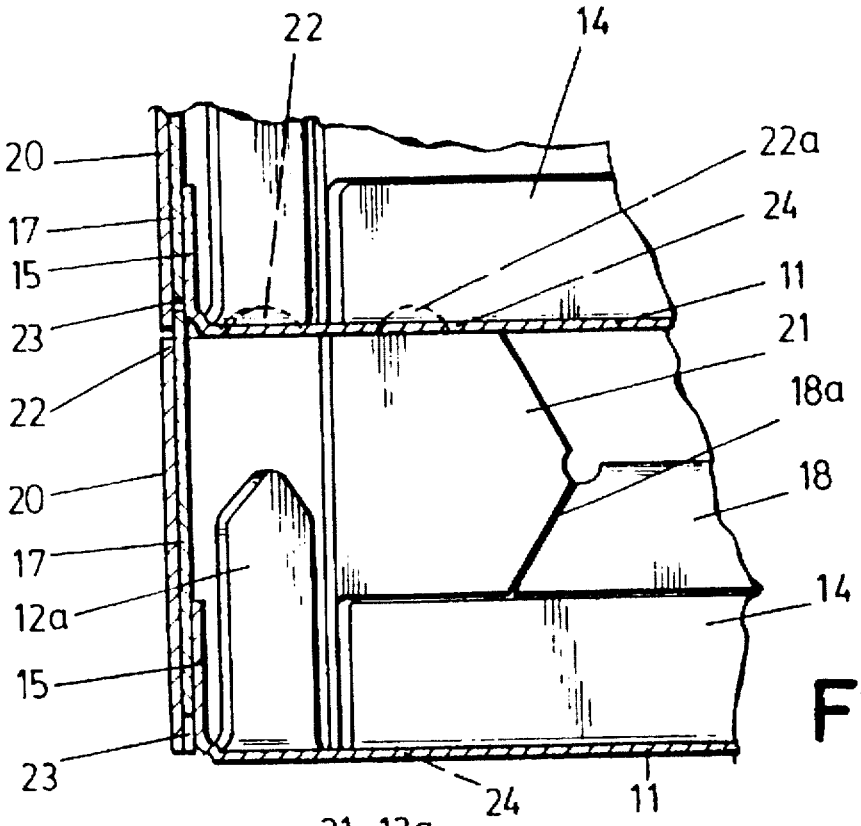
FIG. 25 is a partial sectional view of the two trays shown in FIG. 24, with the trays piled up.
Figure 26:
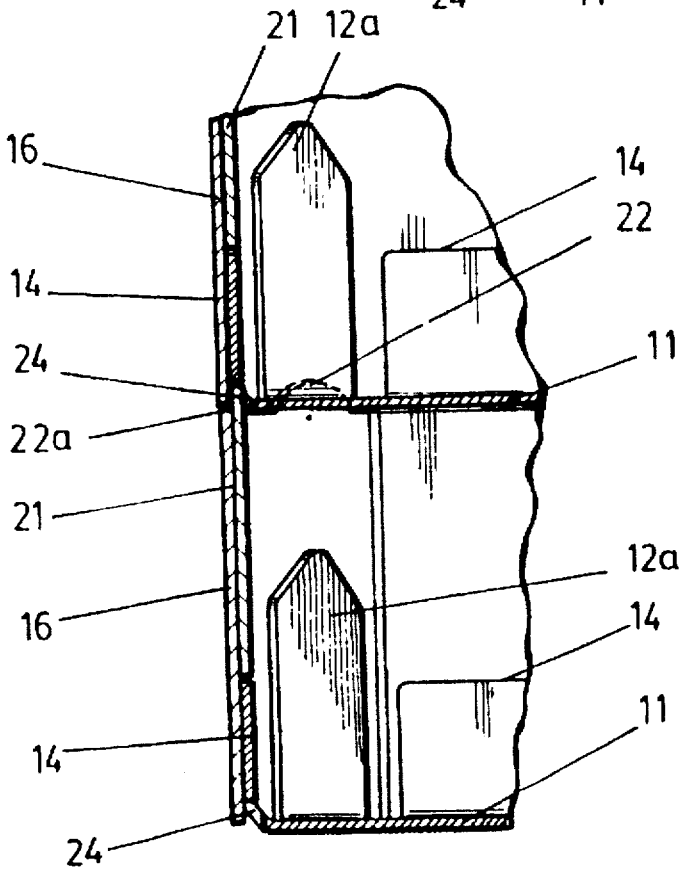
FIG. 26 is a partial sectional view taken along line A–B of FIG. 22 and showing two trays piled up.
Figure 27:
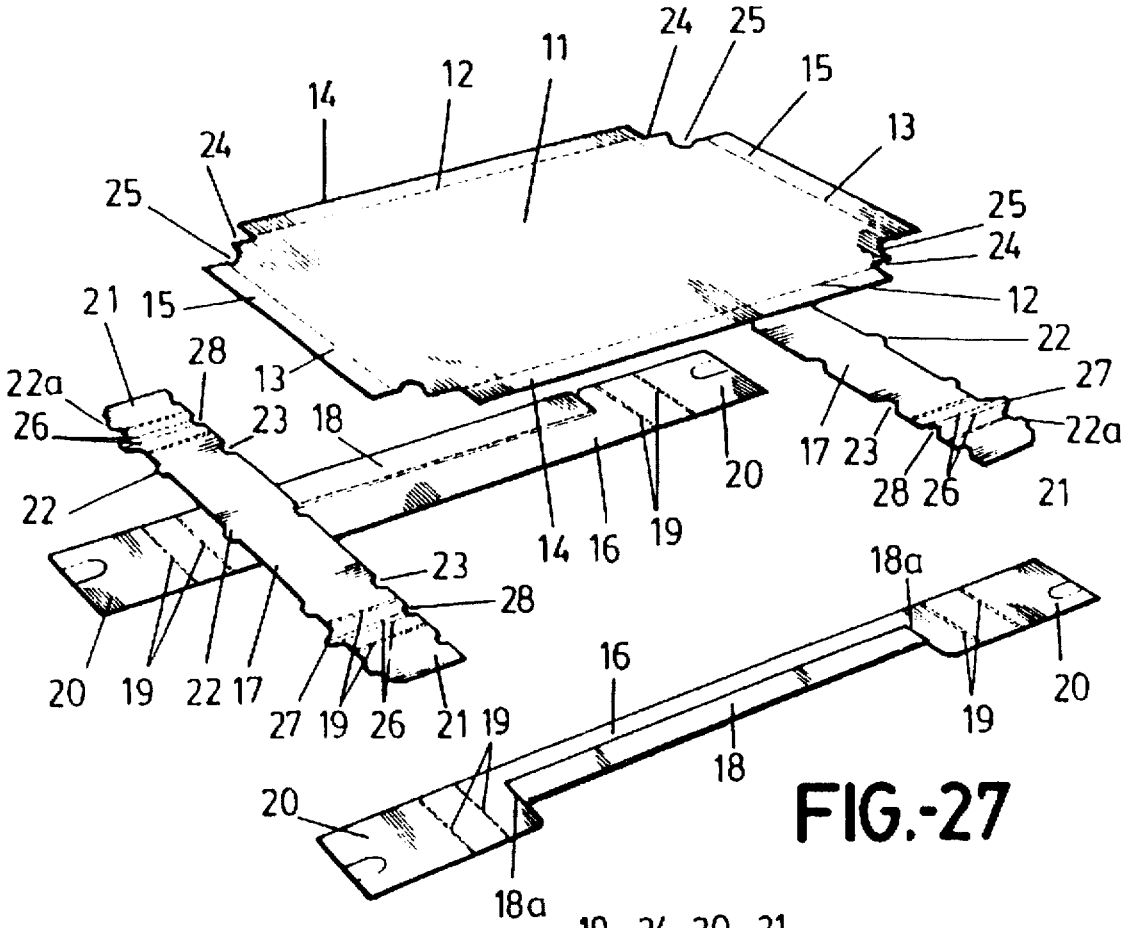
FIG. 27 is an exploded perspective view of a tray manufactured according to a modified embodiment.
Figure 28:
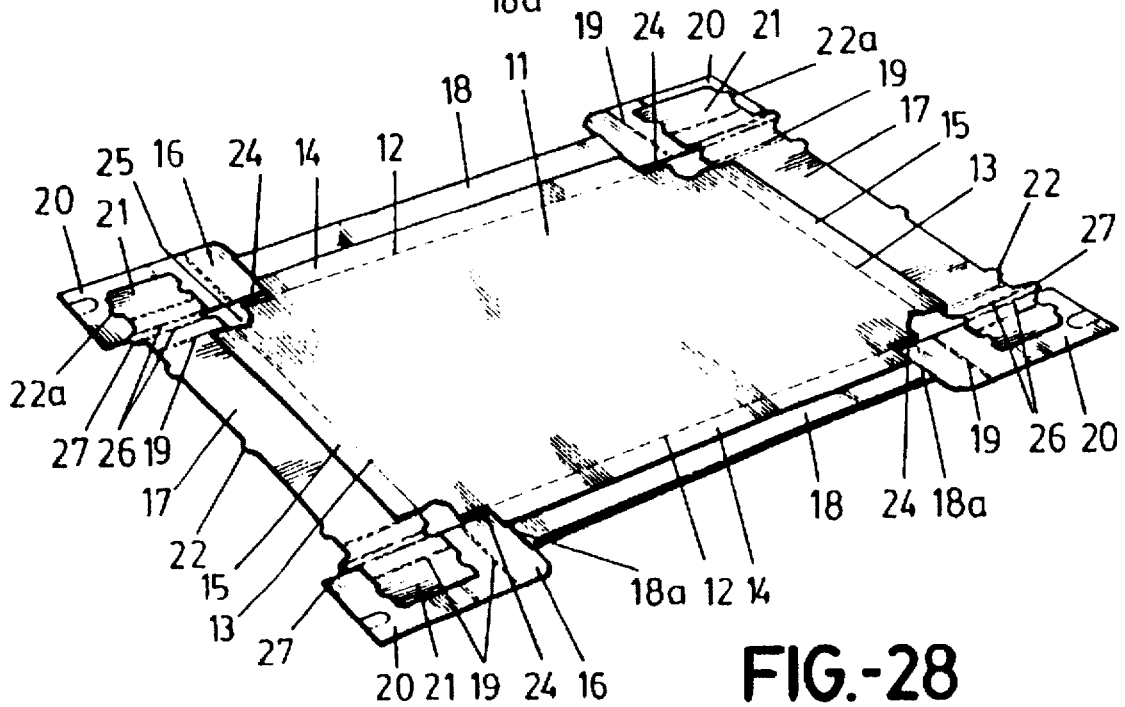
FIG. 28 is a perspective view of the components of FIG. 27 in the assembled state.
Figure 29:
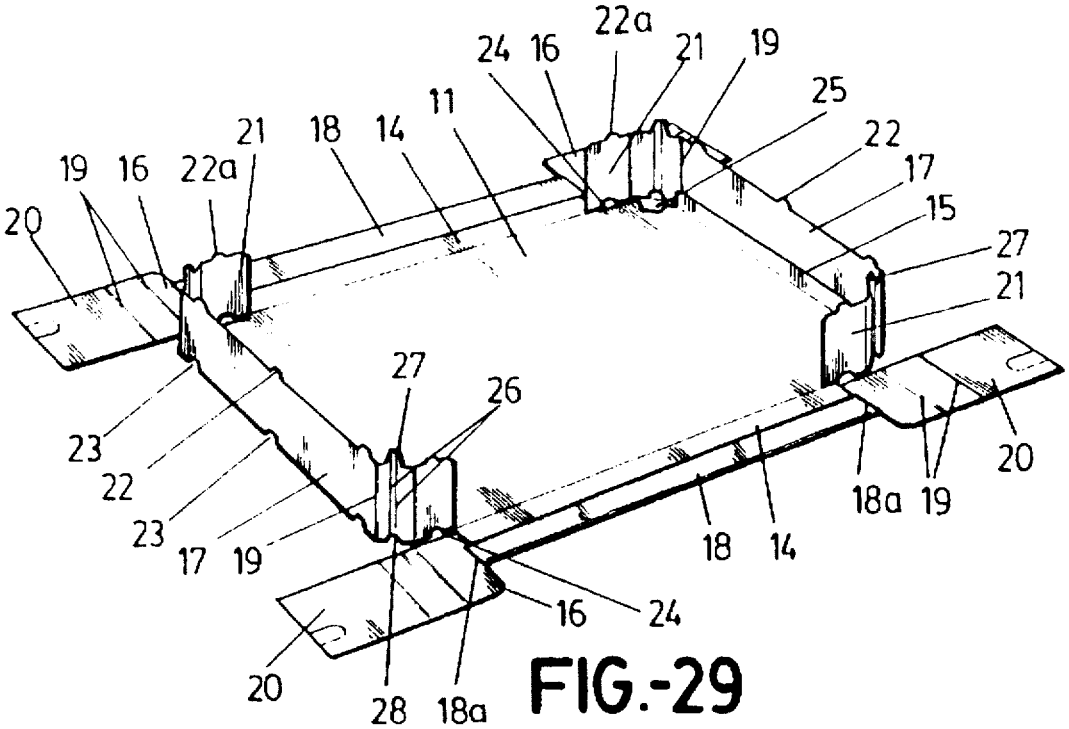
FIG. 29 is a perspective view of the components of FIG. 27, during the intermediate stage of the manufacturing process.
Figure 30:
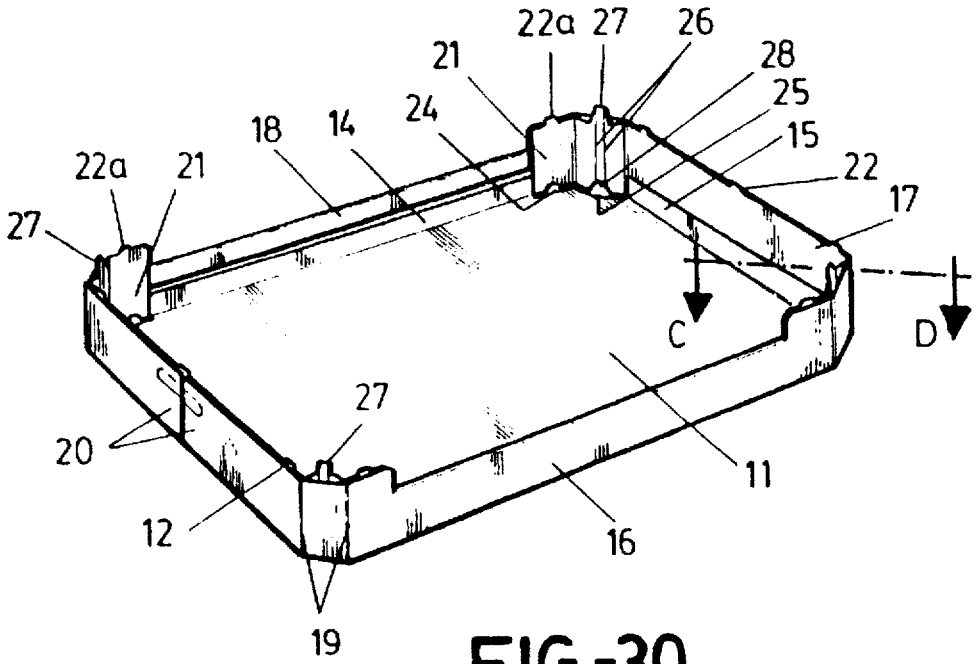
FIG. 30 shows a perspective view of the tray at the final stage of the process.

Due to this position, when piling up the trays, the wings (22) are placed in the notches (23) and the wings (22*a*) are placed in the openings (24) to immobilize the trays piled up (FIGS. 24, 25 and 26).

It must be noted that the notches (23) remain in a hidden position, because the faces (17) are placed between the wings (20) at one side and the flanges (15) at the other side.

As shown in FIG. 24, the extremity (18*a*) of the flange (18), the extremity of the flange (14) and the extremity of the wing (21), are all glued to the inner surface of the sides (16). Due to this position, the larger sides (16) are reinforced by the above-described components.

The smaller sides (17) are reinforced by the flanges (15) and also by the wings (20).

The trays of the present invention have such characteristics of resistance to compressions that allow to pile them up as they are loaded, without danger of being deformed.

According to yet another embodiment of the tray, as shown in FIGS. 27 to 32, the bottom (11) of the cask has next to its corners recesses (25) of considerable size, and has also the wings (21) placed at the two folding lines (19), and two other folding intermediate lines (26) parallel to the lines (19) and between the opposite folding lines, an upper elongation (27) is provided.

Figure 31:
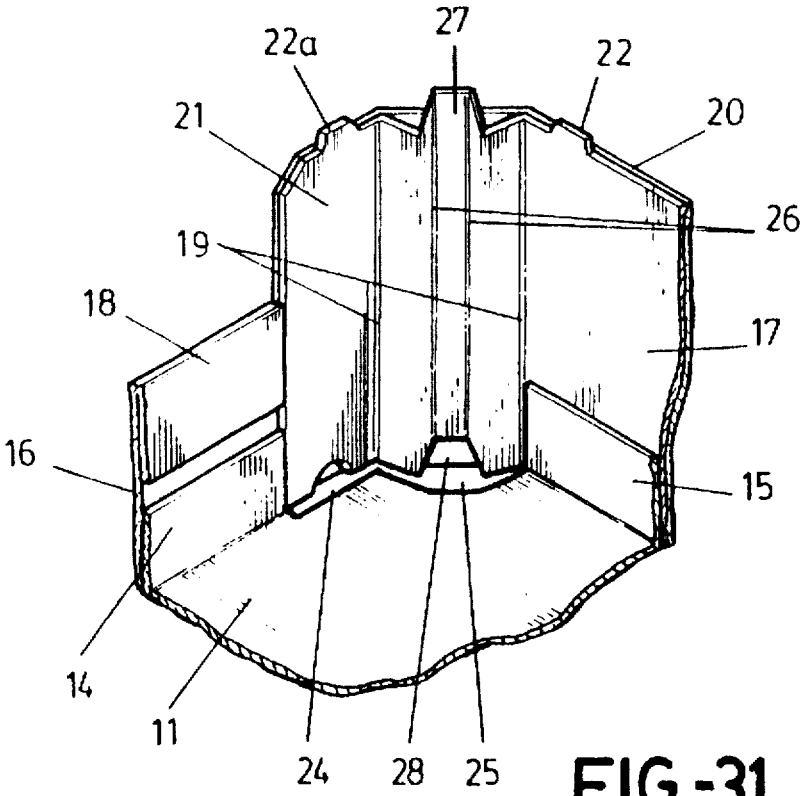
FIG. 31 is a perspective view of one of the corners of the trays of FIGS. 27 to 30, on enlarged scale.
Figure 32:
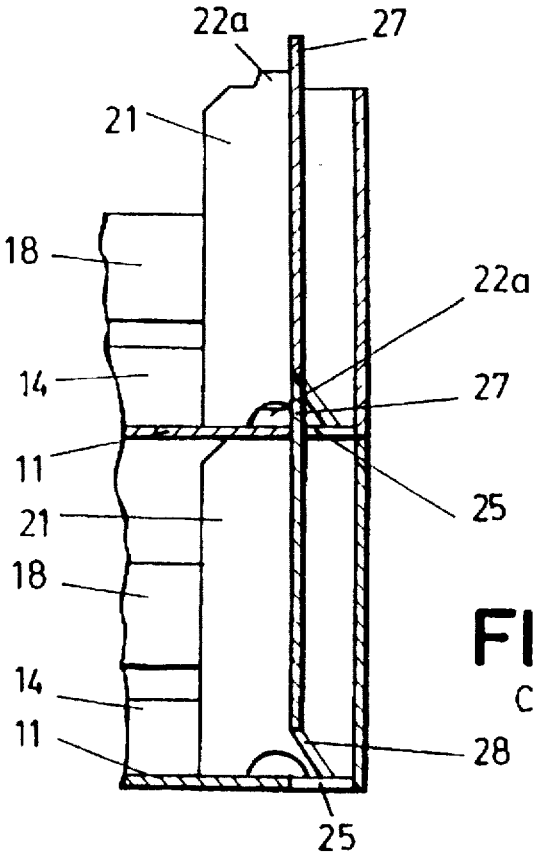
FIG. 32 is a partial sectional view of two trays piled up, taken on line A–B of FIG. 30.

Each wing (21) further has notches (28) at the elongations (21) between the folding lines (19), the width of which is slightly oversized with respect to a section also corresponding to the bevel of the wings (20) limited by the folding lines (19) similarly to the forming of the box, as seen in FIG. 31. Hollow columns are defined in the areas of the bevels whose shape and size are complementary with the shape and size of the notches 25) provided in the cask or bottom (11) of the box or tray. As shown in FIG. 32, the upper elongations (27) at the opening of each box extend transversely to the notch (25) of the box positioned immediately above, until the top of the notch (28), which makes it easier to handle piling up of the boxes because of a self-centering positioning between the boxes or trays in a pile.

Figure 33:
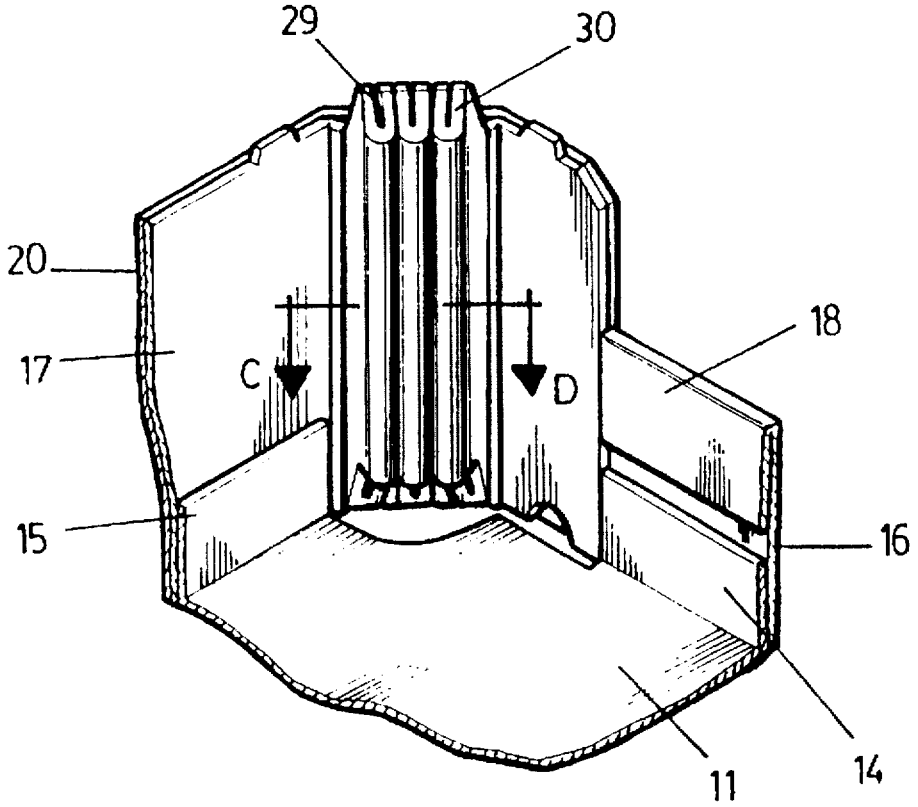
FIG. 33 is a perspective view of one of the corners of a box according to yet another embodiment.
Figure 34:
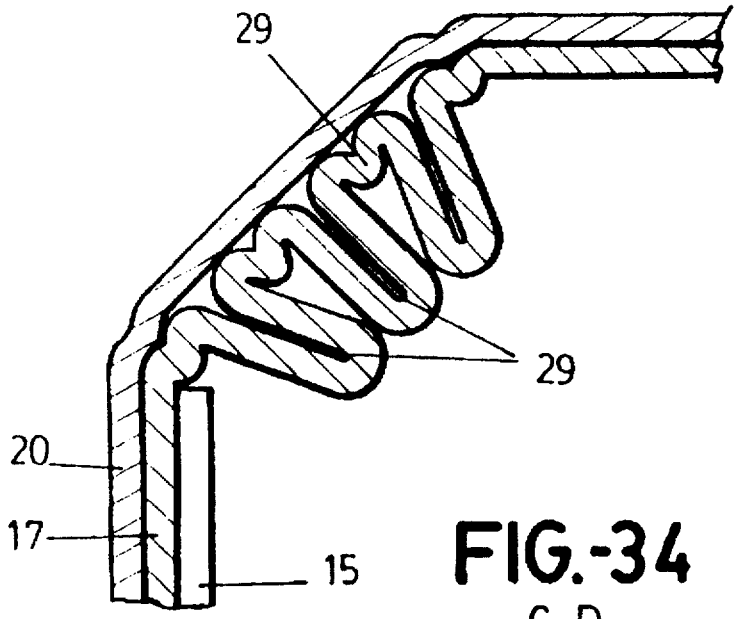
FIG. 34 is a sectional view taken along line C–D of FIG. 33.

Optionally, the section of the strips (17) may comprise a plurality of folds (29) between the folding lines (21), which could make strips (17) considerably more oversized. As seen in FIGS. 33 and 34, folds (29) transform the columns at the vertical edges of the box into solid elements, which contributes to a remarkable stiffness of the tray structure at the level of the vertical edges and improves the piling up conditions of the trays.

Each set of folds (29) of a double bevel edge in its upper extremity has folds (30), as shown in FIGS. 33 and 34. This would make the column of the folds (29) have a "sharpening" effect that makes the handling of piling up of the tray easier.

The smaller sides (17) are reinforced by the flanges (15) and also by the wings (20).

The advantages of the present invention are the following:

(a) Simplification in the manufacturing process, as compared to the known process which begins with forging of plates, providing folding lines that muse be bent, assembling or glueing flanges, wings or any other components.

(b) This simplification also affects the way by which the means of assembling by superposition are obtained which is must simpler than that for the tray obtained by the known process.

(c) Greater resistance to compression, specifically in the case where the trays have arch-shaped vertical edges. This resistance can be increased by joining the strips (4) glued to the inner side or outside of the edges of the tray, the fold (4*a*), or the columns (9–15).

(d) Due to the arch-shaped vertical edges or bevel shape thereof, it is possible to avoid hits and rubbing while handling the trays.

(e) Production of the trays is of lower cost because it is possible to obtain the bottom (1) of a specific quality and the walls (3, 14 and 15) of good quality, suitable for printing on the outside surface of the tray. In the trays formed by one single piece, all parts of the tray are made of the same material.

(f) The printing of the side walls (3, 14 and 15) of the tray is easier and cheaper, as compared to the printing on the sides of the trays made of a single piece, because it is much easier to handle the bands (3, 14 and 15) than a piece of a greater sizer as is the case in the known trays.

Figure 10:
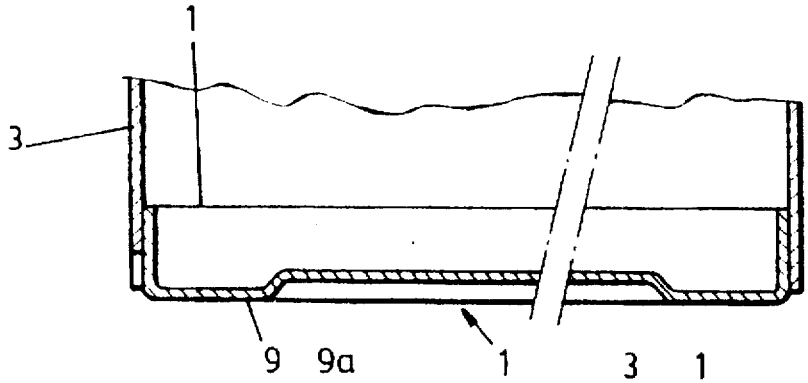
FIG. 10 is a cross-sectional view of a tray having a bottom provided with an indentation.

(g) The invention provides the possibility of reinforcing the bottom of the tray by marquetry (FIG. 10).

I claim:

1. A stackable tray for the transportation of goods, comprising: one piece of compact cardboard forming a bottom of the tray and a marginal flange, and an additional piece or pieces of compact cardboard forming a side wall of the tray, the piece or pieces forming the side wall of the tray being fixed to the outside of the marginal flange of the bottom and joined at corners of the tray forming reinforced corners including folded-over flanges extending upward forming pile-up stubs.

2. The stackable tray recited in claim 1, formed from five pieces of compact cardboard fixed together by glue, one piece forming the bottom of the tray and the other four pieces forming the walls, a longer two of said other four pieces forming opposite sides and having elongated ends formed into a folding wing shape demarked by transverse scored lines on the pieces, the elongated ends being superposed with and glued to a shorter two of said four pieces, covering them totally, the shorter two of said four pieces having elongated ends formed into a folding wing shape demarked by transverse scored lines on the pieces, the elongated ends being superposed with and glued to the longer two of said four pieces.

3. The stackable tray recited in claim 2, wherein further the elongated ends of the shorter pieces have at an upper edge thereof rising tabs corresponding to slots precut in the bottom of the tray, next to the marginal flange of said bottom.

4. The stackable tray recited in claim 1, wherein the sidewall having a lower edge disposed as to be in contact with the bottom of the tray.

5. The stackable tray recited in claim 1, wherein the sidewall is formed of two longer sides and two shorter sides;

the longer sides are provided along upper edges with the folded-over flanges and also include wing-shaped extensions at each end;

inner surfaces of the corresponding side of wing-shaped extensions are provided with glue; and outer surfaces of the shorter sides are provided with glue, the wing-shaped extensions of the longer sides being positioned over, glued to, and totally covering the shorter sides.

6. The stackable tray recited in claim 1 wherein the sidewall is formed of two longer sides and two shorter sides;

the bottom of the tray includes notches provided at each of the corners, the notches and the pile-up stubs being complementarily disposed so that the pile-up stubs of a first tray occupy the notches of a second tray when the second tray is stacked atop the first tray, whereby a stack of trays is stabilized.

7. The stackable tray recited in claim 1, formed of a bottom piece, two longer side pieces, and two shorter side pieces, wherein:

each of the side pieces has extensions with score lines to facilitate folding;

when the extensions of the side pieces are folded as indicated by the score lines and glued together at corners of the tray, vertical columns with a length greater than the tray's height are formed, the vertical columns are hollow for at least a portion at upper ends thereof;

outside dimensions of said vertical columns at lower ends thereof being no greater than inside dimensions of said vertical columns at upper ends thereof, said bottom piece having cropped corners so as not to cover ends of said columns;

whereby when stacking the tray on a second tray, corresponding vertical columns engage.

8. The tray recited in claim 7, wherein further:

said extensions of said side pieces and said score lines are such that when the extensions of the side pieces are folded as indicated by the score lines and glued together at corners of the tray, the vertical columns formed are substantially solid except for at least said hollow portion at upper ends thereof.

9. The stackable tray recited in claim 1, wherein the one piece and additional piece or pieces of compact cardboard are of a different resistance, thereby enabling the tray to be adapted to the goods being transported.

10. The stackable tray recited in claim 1, wherein the folded-over flanges have bevelled upper edges.

* * * * *